US008500487B2

(12) United States Patent
Morgan et al.

(10) Patent No.: US 8,500,487 B2
(45) **Date of Patent: *Aug. 6, 2013**

(54) GROUNDING STRUCTURES FOR HEADER AND RECEPTACLE ASSEMBLIES

(75) Inventors: Chad William Morgan, Carneys Point, NJ (US); Timothy Robert Minnick, Enola, PA (US); Dharmendra Saraswat, Harrisburg, PA (US); Nathan William Swanger, Mechanicsburg, PA (US); Charles S. Pickles, York, PA (US); Justin Shane McClellan, Camp Hill, PA (US); Lynn Robert Sipe, Mifflintown, PA (US); James Lee Fedder, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 85 days.

This patent is subject to a terminal disclaimer.

(21) Appl. No.: 13/296,852

(22) Filed: Nov. 15, 2011

(65) Prior Publication Data

US 2013/0122744 A1 May 16, 2013

(51) Int. Cl.
*H01R 13/648* (2006.01)

(52) U.S. Cl.
USPC ..... 439/607.06

(58) Field of Classification Search
USPC ..... 439/607.06–607.11, 607.13, 607.23, 439/101, 108, 939
See application file for complete search history.

(56) References Cited

U.S. PATENT DOCUMENTS

| | | | | |
|---|---|---|---|---|
| 7,976,340 | B1 * | 7/2011 | Saraswat et al. | 439/607.07 |
| 8,398,432 | B1 * | 3/2013 | McClellan et al. | 439/607.07 |
| 2007/0099455 | A1 * | 5/2007 | Rothermel et al. | 439/108 |
| 2008/0233806 | A1 * | 9/2008 | Rothermel et al. | 439/676 |
| 2010/0022129 | A1 * | 1/2010 | Morgan | 439/607.05 |
| 2010/0035454 | A1 * | 2/2010 | Morgan et al. | 439/296 |
| 2010/0048058 | A1 * | 2/2010 | Morgan et al. | 439/607.05 |

FOREIGN PATENT DOCUMENTS

| | | | |
|---|---|---|---|
| EP | 2194609 | * | 9/2010 |
| EP | 2194612 | * | 9/2010 |

* cited by examiner

*Primary Examiner* — Tulsidas C Patel
*Assistant Examiner* — Phuongchi T Nguyen

(57) ABSTRACT

A receptacle assembly includes a front housing configured for mating with a header assembly and a contact module coupled to the front housing. The contact module includes a conductive holder having a first side wall and an opposite second side wall. The conductive holder has a chamber between the first and second side walls. The conductive holder has a front coupled to the front housing. The contact module includes a frame assembly that is received in the chamber. The frame assembly includes a plurality of contacts and a dielectric frame that supports the contacts. The contacts extend from the conductive holder for electrical termination. A plurality of ground clips are received in the chamber and extend from the front of the conductive holder. The ground clips are mechanically and electrically connected to the conductive holder.

20 Claims, 8 Drawing Sheets

GROUNDING STRUCTURES FOR HEADER AND RECEPTACLE ASSEMBLIES

BACKGROUND OF THE INVENTION

The subject matter herein relates generally to grounding structures in connector assemblies.

Electrical systems, such as those used in networking and telecommunication systems, utilize receptacle and header connectors to interconnect components of the system, such as a motherboard and daughtercard. However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground contacts on both electrical connectors that are connected together to electrically connect the ground circuits of the electrical connectors. Typically, the connection between the ground contacts is located at a single point of contact, such as at a point above a differential pair of signal contacts. Some known connectors provide side shielding along the sides of the differential pairs in the form of a folded-over ground tab on each side of the differential pair, which is implemented on the header connector as part of the ground contact of the header connector. However, known connector systems do not include a direct connection of the folded-over ground tabs to a side ground shield of the receptacle connector, which causes the folded-over ground tabs to act as resonating structures that cause cross-talk in higher frequency applications.

A need remains for an electrical system having improved shielding to meet particular performance demands.

BRIEF DESCRIPTION OF THE INVENTION

In one embodiment, a receptacle assembly is provided having a front housing configured for mating with a header assembly and a contact module coupled to the front housing. The contact module includes a conductive holder having a first side wall and an opposite second side wall. The conductive holder has a chamber between the first and second side walls. The conductive holder has a front coupled to the front housing. The contact module includes a frame assembly that is received in the chamber. The frame assembly includes a plurality of contacts and a dielectric frame that supports the contacts. The contacts extend from the conductive holder for electrical termination. A plurality of ground clips are received in the chamber and extend from the front of the conductive holder. The ground clips are mechanically and electrically connected to the conductive holder.

In another embodiment, a receptacle assembly is provided having a front housing configured for mating with a header assembly and a contact module coupled to the front housing. The contact module includes a conductive holder having a first holder member and second holder member coupled to the first holder member. The conductive holder has a front coupled to the front housing and a bottom configured to be mounted to a circuit board. The conductive holder has a chamber between the first and second holder members. The chamber includes a plurality of channels that extend between the front and the bottom. A frame assembly is received in the chamber. The frame assembly includes a first frame member that is received in the first holder member and a second frame member that is received in the second holder member. Each frame member includes a plurality of contacts and a dielectric frame that support the contacts. The contacts are routed through corresponding channels. The contacts extend from the front and the bottom for electrical termination. Ground clips are received in corresponding channels of the chamber. The ground clips extend from the front of the conductive holder. The ground clips are mechanically and electrically connected to the conductive holder.

In a further embodiment, an electrical connector assembly is provided having a header assembly and a receptacle assembly. The header assembly includes a header housing, a plurality of header contacts that are held by the header housing, and a plurality of C-shaped header shields that surround corresponding header contacts. The header shields have walls defining the C-shaped header shields. The receptacle assembly includes a front housing matable to the header housing. A contact module is coupled to the front housing. The contact module includes a conductive holder that has a first holder member and second holder member coupled to the first holder member. The conductive holder has a front coupled to the front housing and a bottom configured to be mounted to a circuit board. The conductive holder has a chamber between the first and second holder members. The chamber includes a plurality of channels that extend between the front and the bottom. A frame assembly is received in the chamber. The frame assembly includes a first frame member that is received in the first holder member and a second frame member that is received in the second holder member. Each frame member includes a plurality of contacts and a dielectric frame supporting the contacts. The contacts are routed through corresponding channels. The contacts extend from the front of the conductive holder for electrical termination to corresponding header contacts. Ground clips are received in corresponding channels of the chamber. The ground clips extend from the front of the conductive holder for electrical termination to corresponding header shields. The ground clips are mechanically and electrically connected to the conductive holder.

DETAILED DESCRIPTION OF THE INVENTION

Figure 1:
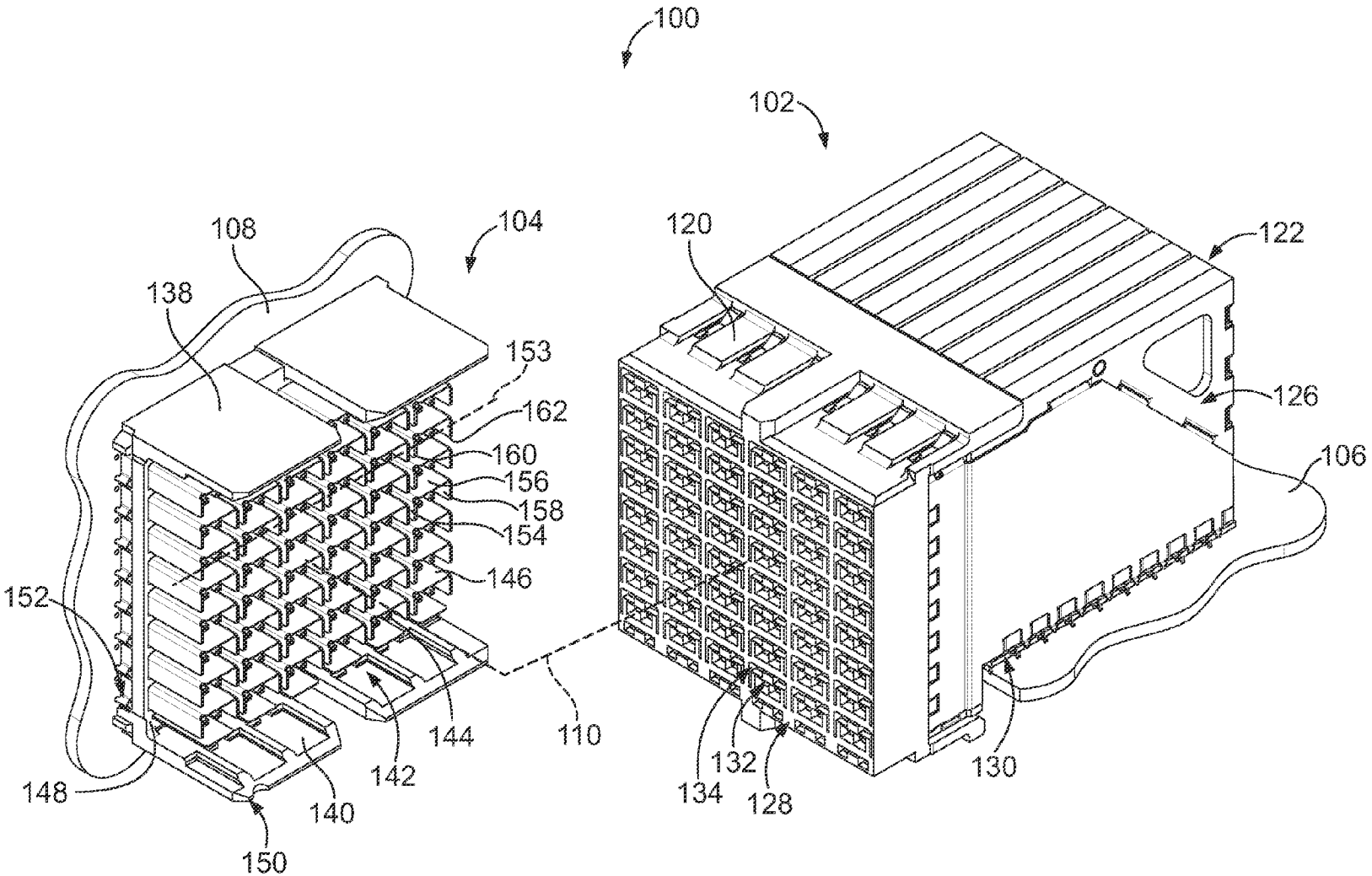
FIG. 1 is a perspective view of an exemplary embodiment of an electrical connector system illustrating a receptacle assembly and a header assembly.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. The shield structure 126 includes multiple components, electrically interconnected, which provide the electrical shielding. Optionally, the shield structure 126 may provide electrical shielding for differential pairs of the receptacle signal contacts 124 to shield the differential pairs from one another. In an exemplary embodiment, the shield structure 126 is electrically connected to the header assembly 104 and/or the circuit board 106. For example, the shield structure 126 may be electrically connected to the header assembly 104 by extensions (e.g. beams, clips or fingers) provided at the front of the contact modules 122 that engage the header assembly 104. Optionally, as in the embodiments illustrated herein, the extensions may extend from the contact modules 122. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The columns of receptacle signal contacts 124 are all held in a common contact module 122. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding beams 302 (shown in FIG. 2) and grounding fingers 332 (shown in FIG. 2) of the contact modules 122 that mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144.

The receptacle assembly 102 may have other forms and components in alternative embodiments and may be mated to a different type of header assembly 104. The receptacle assembly 102 may not include a front housing and separate contact modules, but rather have a single housing or holder that holds all of the receptacle signal contacts. The receptacle assembly 102 may not have individual contact modules or chicklets, but rather may include a single contact module holding all of the receptacle signal contacts that is loaded into the front housing. The receptacle assembly 102 may have contact modules that are oriented horizontally rather than vertically.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108. In an alternative embodiment, the header assembly may be a cable mounted header assembly with individual cable mounted header connectors (e.g. signal contacts and header shields), which are held in a common header housing.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The header shields 146 have edges 160, 162 at opposite ends of the header shields 146. The edges 160, 162 are downward facing. The edges 160, 162 are provided at the distal ends of the walls 154, 158, respectively. The bottom is open between the edges 160, 162. The header shield 146 associated with another pair of header signal contacts 144 provides shielding along the open, fourth side thereof such that each of the pairs of signal contacts 144 is shielded from each adjacent pair in the same column and the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
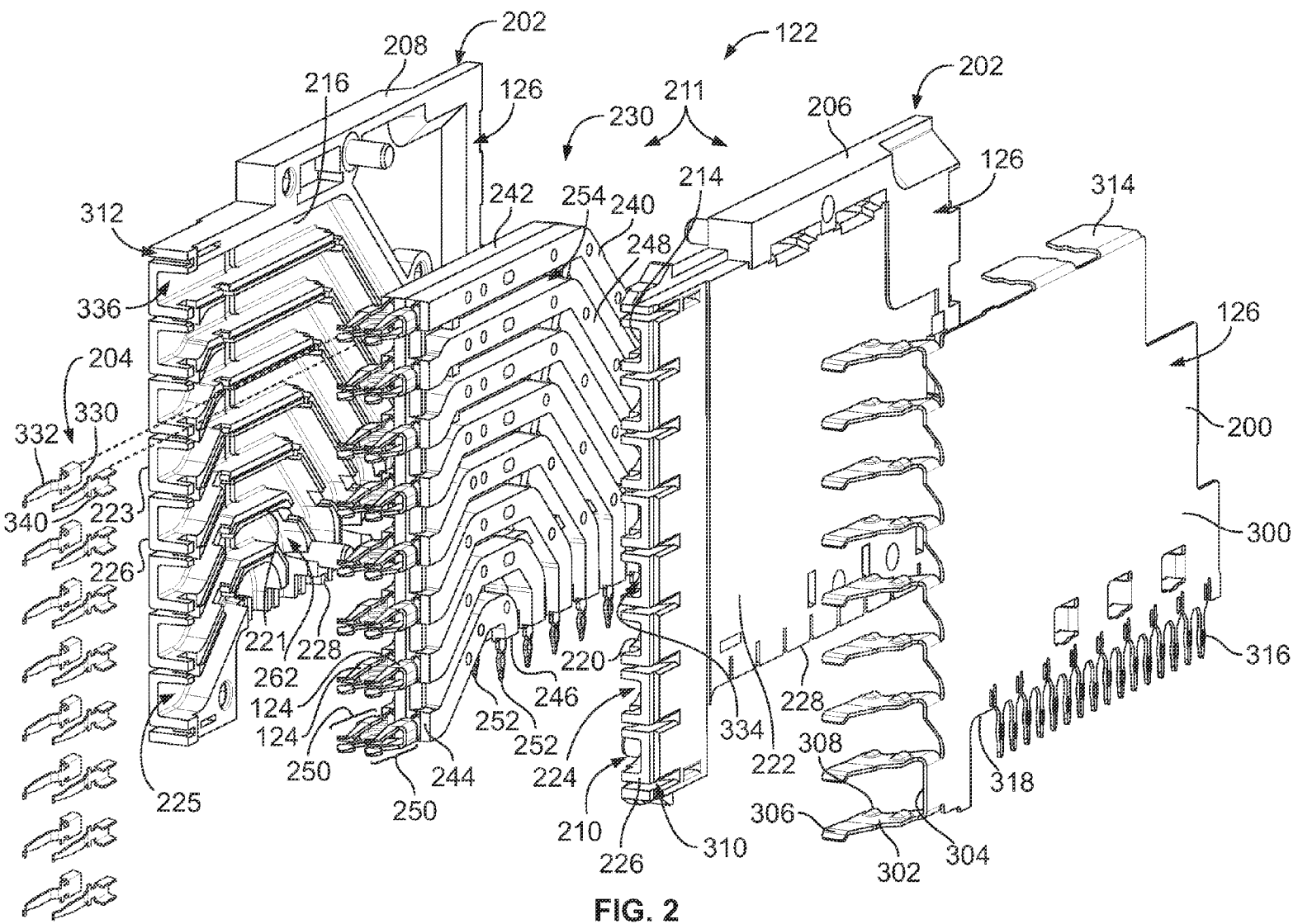
FIG. 2 is an exploded view of a contact module for the receptacle assembly shown in FIG. 1.

FIG. 2 is an exploded view of one of the contact modules 122 and part of the shield structure 126. The shield structure 126 includes a ground shield 200, a conductive holder 202 and a plurality of ground clips 204 that are coupled to the conductive holder 202. The ground shield 200 and ground clips 204 electrically connect the contact module 122 to the header shields 146 (shown in FIG. 1). The ground shield 200 and ground clips 204 provide multiple, redundant points of contact to the header shield 146. The ground shield 200 and ground clips 204 provide shielding on all sides of the receptacle signal contacts 124.

The contact module 122 includes the conductive holder 202, which in the illustrated embodiment includes a first holder member 206 and a second holder member 208 that are coupled together to form the holder 202. The holder members 206, 208 are fabricated from a conductive material. For example, the holder members 206, 208 may be die-cast from a metal material. Alternatively, the holder members 206, 208 may be stamped and formed or may be fabricated from a plastic material that has been metalized or coated with a metallic layer. By having the holder members 206, 208 fabricated from a conductive material, the holder members 206, 208 may provide electrical shielding for the receptacle assembly 102. When the holder members 206, 208 are coupled together, the holder members 206, 208 define at least a portion of the shield structure 126 of the receptacle assembly 102.

The holder members 206, 208 include chambers 210, 212 that together define a common chamber 211 (combination of chambers 210 and 212) of the conductive holder 202. The common chamber 211 receives a frame assembly 230, which includes the receptacle signal contacts 124, therein. The holder members 206, 208 provide shielding around the frame assembly 230 and receptacle signal contacts 124. The chambers 210, 212 are defined by internal surfaces 214, 216 of side walls 222, 223, respectively, of the holder members 206, 208. In an exemplary embodiment, the ground clips 204 are configured to be at least partially received in the chambers 210, 212. The ground clips 204 are coupled to the internal surfaces 214, 216.

The holder members 206, 208 include tabs 220, 221 extending inward from side walls 222, 223 thereof. The tabs 220 extend into the chamber 210 and divide the chamber 210 into discrete channels 224. The channels 224 are bounded by the tabs 220 and the internal surface 214 extending between the tabs 220. The tabs 221 extend into the chamber 212 and divide the chamber 212 into discrete channels 225. The channels 225 are bounded by the tabs 221 and the internal surface 216 extending between the tabs 221. The tabs 220, 221 define at least a portion of the shield structure 126 of the receptacle assembly 102. The tabs 220, 221 provide shielding between the channels 224 and the channels 225, respectively. When assembled, the holder members 206, 208 are coupled together and the channels 224, 225 are aligned to form common channels that are completely surrounded by the conductive material of the holder members 206, 208 (e.g. the side walls 222, 223 and tabs 220, 221), thus providing 360° shielding for the receptacle signal contacts 124 received therein. When assembled, the holder members 206, 208 define a front 226 and a bottom 228 of the conductive holder 202.

The conductive holder 202 may have other shapes and features in an alternative embodiment. For example, the conductive holder 202 may be a single piece rather than having the two holder members 206, 208 coupled together. The conductive holder 202 may include multiple chambers and receive multiple frame assemblies 230. For example, the conductive holder 202 may hold all of the frame assemblies 230 of the receptacle assembly 102 and be connected to the front housing 120, or directly to the header assembly 104.

The contact module 122 includes the frame assembly 230, which is held by the conductive holder 202. The frame assembly 230 includes the receptacle signal contacts 124. The frame assembly 230 includes a pair of dielectric frames 240, 242 surrounding the receptacle signal contacts 124. In an exemplary embodiment, the receptacle signal contacts 124 are initially held together as lead frames (not shown), which are overmolded with dielectric material to form the dielectric frames 240, 242. Other manufacturing processes may be utilized to form the dielectric frames 240, 242 other than overmolding a lead frame, such as loading receptacle signal contacts 124 into a formed dielectric body.

The first and second dielectric frames 240, 242 are substantially similar to one another and only the dielectric frame 240 is described in detail. The dielectric frame 240 includes a front wall 244 and a bottom wall 246. The dielectric frame 240 includes a plurality of frame members 248. The frame members 248 hold the receptacle signal contacts 124. For example, a different receptacle signal contact 124 extends along, and inside of, a corresponding frame member 248. The frame members 248 encase the receptacle signal contacts 124.

The receptacle signal contacts 124 have mating portions 250 extending from the front wall 244 and contact tails 252 extending from the bottom wall 246. Other configurations are possible in alternative embodiments. The mating portions 250 and contact tails 252 are the portions of the receptacle signal contacts 124 that extend from the dielectric frame 240. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frame 240. When the contact module 122 is assembled, the mating portions 250 extend forward from the front 226 of the holder 202 and the contact tails 252 extend downward from the bottom 228 of the holder 202.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

During assembly, the dielectric frame 240 and corresponding receptacle signal contacts 124 are loaded into the chamber 210 and are coupled to the holder member 206. The frame members 248 are received in corresponding channels 224. The tabs 220 are received in corresponding windows 254 such that the tabs 220 are positioned between adjacent receptacle signal contacts 124. The dielectric frame 242 and corresponding receptacle signal contacts 124 are loaded into the chamber 212 and are coupled to the holder member 208 in a similar manner, with the tabs 221 extending through the dielectric frame 242.

The holder members 206, 208, which are part of the shield structure 126, provide electrical shielding between and around respective receptacle signal contacts 124. The holder members 206, 208 provide shielding from electromagnetic interference (EMI) and/or radio frequency interference (RFD. The holder members 206, 208 may provide electrical shielding from other types of interference as well. The holder members 206, 208 provide shielding around the outside of the frames 240, 242, and thus around the outside of all of the receptacle signal contacts 124, as well as between the receptacle signal contacts 124, such as between pairs of receptacle signal contacts 124, using the tabs 220, 221. The holder members 206, 208 control electrical characteristics, such as impedance, cross-talk, and the like, of the receptacle signal contacts 124.

The ground shield 200 includes a main body 300. In the illustrated embodiment, the main body 300 is generally planar. The ground shield 200 includes grounding beams 302 extending forward from a front 304 of the main body 300. In an exemplary embodiment, the grounding beams 302 are bent out of plane with respect to the main body 300 such that the grounding beams 302 are oriented perpendicular with respect to the plane defined by the main body 300. In an exemplary embodiment, the ground shield 200 is manufactured from a metal material. The ground shield 200 is a stamped and formed part with the grounding beams 302 being stamped and then bent during the forming process out of plane with respect to the main body 300. Optionally, the main body 300 may extend vertically while the grounding beams 302 may extend horizontally, however other orientations are possible in alternative embodiments.

The grounding beams 302 extend forward from the front 226 of the holder 202 such that the grounding beams 302 may be loaded into the front housing 120 (shown in FIG. 1). Each grounding beam 302 has a mating interface 306 at a distal end thereof The mating interface 306 is configured to engage the corresponding header shield 146. The grounding beam 302 includes one or more projections 308 extending therefrom. The projections 308 are configured to engage the conductive holder 202 when the ground shield 200 is coupled thereto.

In an exemplary embodiment, the holder members 206, 208 include slots 310, 312, respectively, that receive the grounding beams 302 therein when the ground shield 200 is coupled to the side wall 222 of the holder member 206. The projections 308 are received in the slots 310, 312 and engage the holder members 206, 208 to create an electrical connection with the holder members 206, 208. When the grounding beams 302 are received in the slots 310, 312, the grounding beams 302 are vertically offset with respect to the receptacle signal contacts 124. For example, the grounding beams 302 may be positioned above and/or below corresponding receptacle signal contacts 124. In an exemplary embodiment, the grounding beams 302 are generally aligned with the receptacle signal contacts 124 of both dielectric frames 240, 242. The grounding beams 302 provide electrical shielding between one row of receptacle signal contacts 124 and another row of receptacle signal contacts 124 that is either above or below the one row of receptacle signal contacts 124. The grounding beams 302 are wide enough to generally cover both columns of receptacle signal contacts 124 to provide shielding for the receptacle signal contacts 124 of both columns. The grounding beams 302 may include a two-pronged beam, with one prong aligned with the receptacle signal contacts 124 of the dielectric frame 240 and the other prong aligned with the receptacle signal contacts 124 of the dielectric frame 242.

The ground shield 200 includes a plurality of mounting tabs 314 extending inward from the main body 300. The mounting tabs 314 are configured to be coupled to the holder member 206. The mounting tabs 314 secure the ground shield 200 to the first side wall 222. The mounting tabs 314 engage the holder member 206 to electrically connect the ground shield 200 to the holder member 206. Any number of mounting tabs 314 may be provided. The location of the mounting tabs 314 may be selected to secure various portions of the ground shield 200, such as the top, the back, the front, the bottom, and the like of the ground shield 200 to the holder member 206. The engagement of the projections 308 with the holder 202 help to secure the ground shield 200 to the holder 202. Optionally, the ground shield 200 may engage the holder member 208 in addition to, or in alternative to, the holder member 206.

The ground shield 200 includes a plurality of ground pins 316 extending from a bottom 318 of the ground shield 200. The ground pins 316 are configured to be terminated to the circuit board 106 (shown in FIG. 1). The ground pins 316 may be compliant pins, such as eye-of-the-needle pins, that are throughhole mounted to plated vias in the circuit board 106. Other types of termination means or features may be provided in alternative embodiments to couple the ground shield 200 to the circuit board 106. The ground pins 316 may all be generally coplanar with the main body 300. Alternatively, at least some of the ground pins 316 may be bent out of plane and extend into the dielectric frame 240 and/or 242 such that the ground pins 316 are aligned with the contact tails 252. Optionally, two ground shields 200 may be provided and coupled to both sides of the conductive holder 202.

The ground clips 204 are separate and distinct from one another and from the ground shield 200. The ground clips 204 are manufactured from a metal material. In an exemplary embodiment, the ground clips 204 are stamped and formed. The ground clips 204 each include a base 330 and a grounding finger 332 extending forward from the base 330. The ground clips 204 are configured to be coupled to the side walls 222, 223 of the holder members 206, 208. The ground clips 204 are coupled to the holder members 206, 208 at the front 226 of the holder 202. The ground clips 204 are configured to be loaded into corresponding channels 224, 225 and positioned along an inside of the channels 224, 225. Optionally, the holder members 206, 208 may include pockets 334, 336 along the internal surfaces 214, 216 that receive the ground clips 204 such that ground clips 204 are generally flush with the internal surfaces 214, 216 of the side walls 221, 222 when coupled thereto. The grounding fingers 332 are configured to extend forward of the front 226 of the holder 202 for electrical connection to the header shield 146. The grounding fingers 332 extend along the sides of the receptacle signal contacts 124 forward of the front 226 of the holder 202 to provide shielding along the sides of the receptacle signal contact 124 (e.g., between adjacent pairs of receptacle signal contact 124).

The ground clips 204 include mounting tabs 340 extending from the base 330. The mounting tabs 340 are used to secure the ground clips 204 to the holder members 206, 208. The mounting tabs 340 engage the holder members 206, 208 to electrically connect the ground clips 204 to the holder 202.

Figure 3:
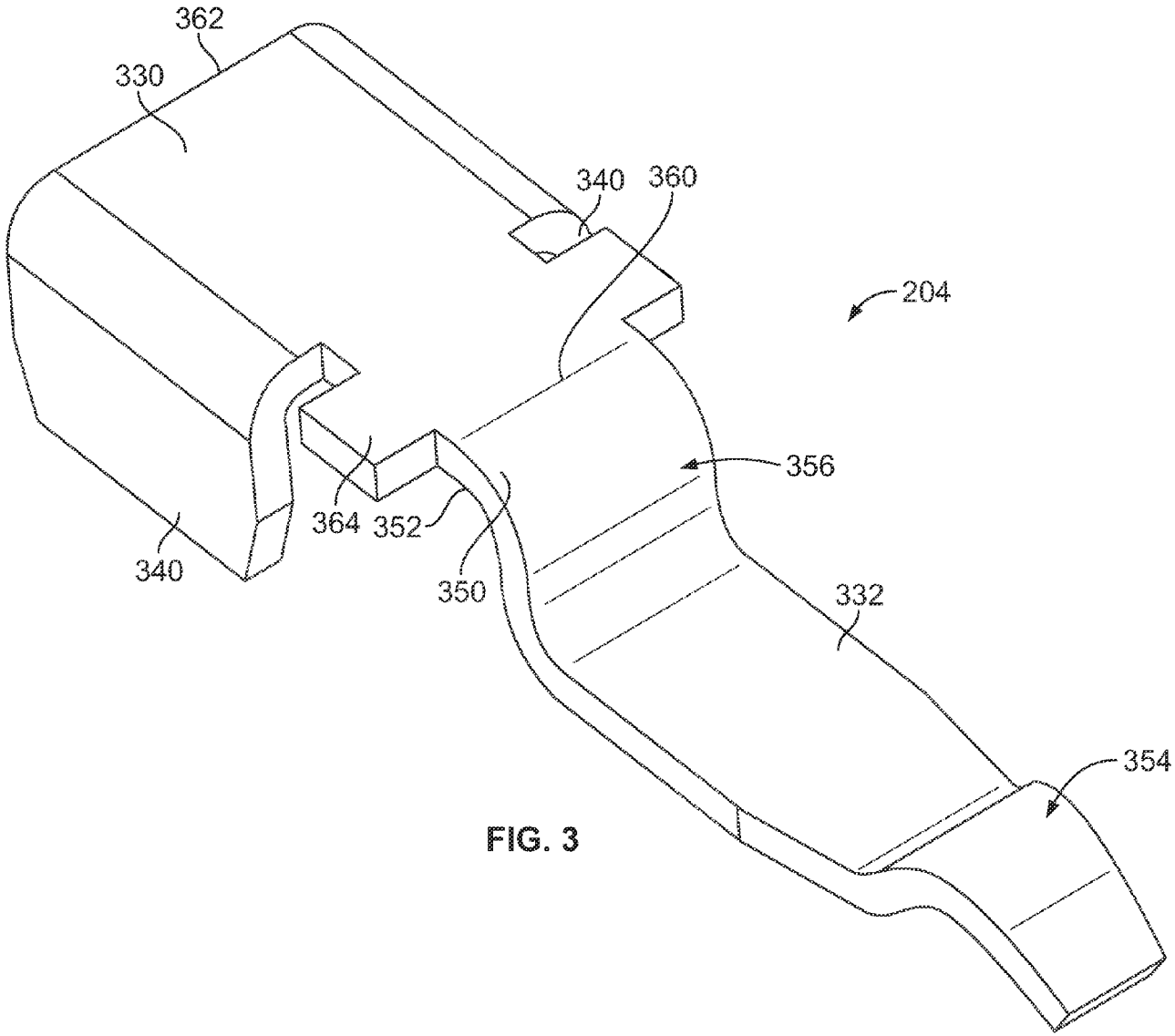
FIG. 3 is a perspective view of a ground clip for the receptacle assembly shown in FIG. 1.

FIG. 3 is a perspective view of one of the ground clips 204 formed in accordance with an exemplary embodiment. The ground clip 204 includes an inner surface 350 and an outer surface 352 opposite the inner surface 350. When mounted to the conductive holder 202 (shown in FIG. 2), the inner surface 350 faces the corresponding receptacle signal contact 124 (shown in FIG. 2) and the outer surface 352 faces the conductive holder 202. In an exemplary embodiment, the ground clip 204 is stamped and formed from a stock metal workpiece. The sheared edges thereof extend between the inner and outer surfaces 350, 352.

The grounding finger 332 is bent out of plane with respect to the base 330 to transition the grounding finger 332 for engagement with the corresponding header shield 146 (shown in FIG. 1). The grounding finger 332 defines a deflectable spring finger that is configured to engage and be spring biased against corresponding header shield 146. The grounding finger 332 includes a mating interface 354 proximate to a distal end thereof. The mating interface 354 may be curved and is the portion of the grounding finger 332 that engages the header shield 146. The grounding finger 332 includes a transition section 356 proximate to the base 330. The transition section 356 transitions the grounding finger 332 out of the plane of the base 330. The transition section 356 transitions the grounding finger 332 away from the receptacle signal contact 124.

The base 330 extends between a front 360 and a rear 362. The grounding finger 332 extends forward from the front 360. The mounting tabs 340 extend from edges of the base 330, at least partially between the front 360 and the rear 362. The mounting tabs 340 are bent out of plane with respect to the base 330. In an exemplary embodiment, the mounting tabs 340 are oriented generally perpendicular with respect to the base 330. The mounting tabs 340 extend outward from the base 330 (e.g., beyond the outer surface 352). The mounting tabs 340 are configured to be press fit into the conductive holder 202, however the ground clip 204 may be electrically and/or mechanically connected to the conductive holder 202 by other means in alternative embodiments. The mounting tabs 364 may be used to position the ground clip 204 with respect to the conductive holder 202 (e.g. front-to-back positioning). Optionally, the mounting tabs 340 may be staked to the holder 202.

Figure 4:
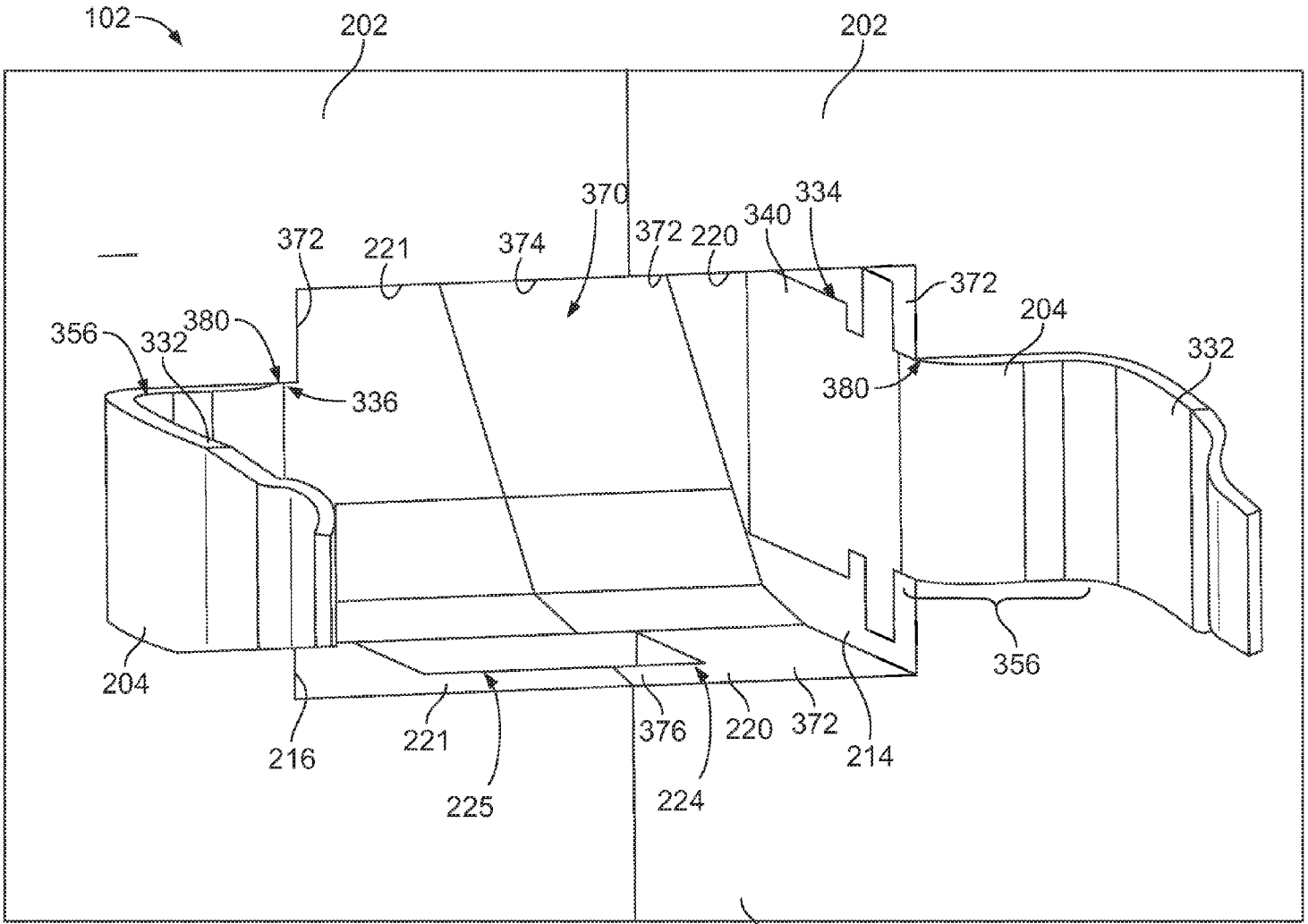
FIG. 4 is a front perspective view of a portion of the contact module shown in FIG. 2 with ground clips of FIG. 3 coupled thereto.

FIG. 4 is a front perspective view of a portion of one contact module 122 showing a pair of ground clips 204 coupled to the conductive holder 202 of the contact module 122. The channels 224, 225 together define a conductive tube or common channel 370 that peripherally surrounds the frame assembly 230 (shown in FIG. 2) when received in the common channel 370. The common channel 370 is rectangular in shape, however other shapes are possible in alternative embodiments. The common channel 370 is defined by a plurality of walls 372 forming the internal surfaces 214, 216 along the sides of the common channel 370, as well as upper and lower internal surfaces 374, 376 along the top and bottom of the common channel 370. The upper and lower internal surfaces 374, 376 are defined by the tabs 220, 221.

The ground clips 204 are located on opposite sides of the common channel 370 in corresponding pockets 334, 336, which are formed along the internal surfaces 214, 216 of the common channel 370. The ground clips 204 may be press fit in the pockets 334, 336. The mounting tabs 340 (shown in FIG. 3) of the ground clips 204 are pressed into the pockets 334, 336 and held therein by an interference fit. The grounding fingers 332 extend out of the common channel 370 forward of the front 226. In an exemplary embodiment, the conductive holder 202 includes chamfered areas 380 at fronts of the pockets 334, 336. The chamfered areas 380 provide a space for the transition sections 356 to transition the grounding fingers 332 outward.

Figure 5:
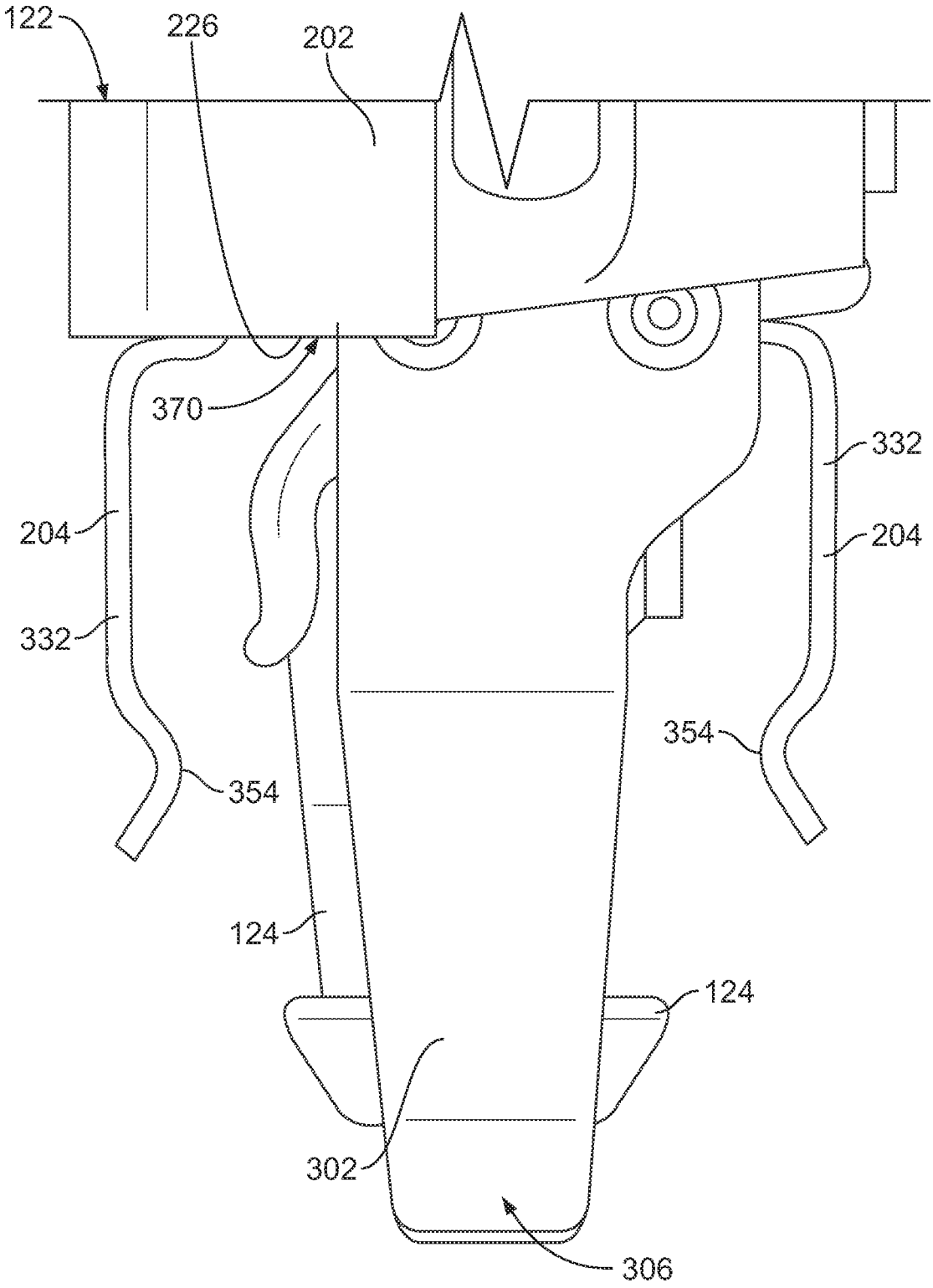
FIG. 5 is a top view of the contact module shown in FIG. 2.

FIG. 5 is a top view of one of the contact modules 122. The differential pair of receptacle signal contacts 124 are arranged side-by-side and extend forward from the front 226 of the conductive holder 202. The grounding beam 302 extends over the top of the pair of receptacle signal contacts 124. The ground clips 204 are arranged along opposite sides of the pair of receptacle signal contacts 124. The ground clips 204 define a direct ground path from the header shield 146 (shown in FIG. 1) to the inside of the channel 370 (shown in FIG. 4) of the conductive holder 202. In an exemplary embodiment, the grounding fingers 332 of the ground clips 204 are shorter than the grounding beam 302 such that the mating interfaces 354 are positioned closer to the front 226 of the conductive holder 202 than the mating interface 306 of the grounding beam 302.

Figure 6:
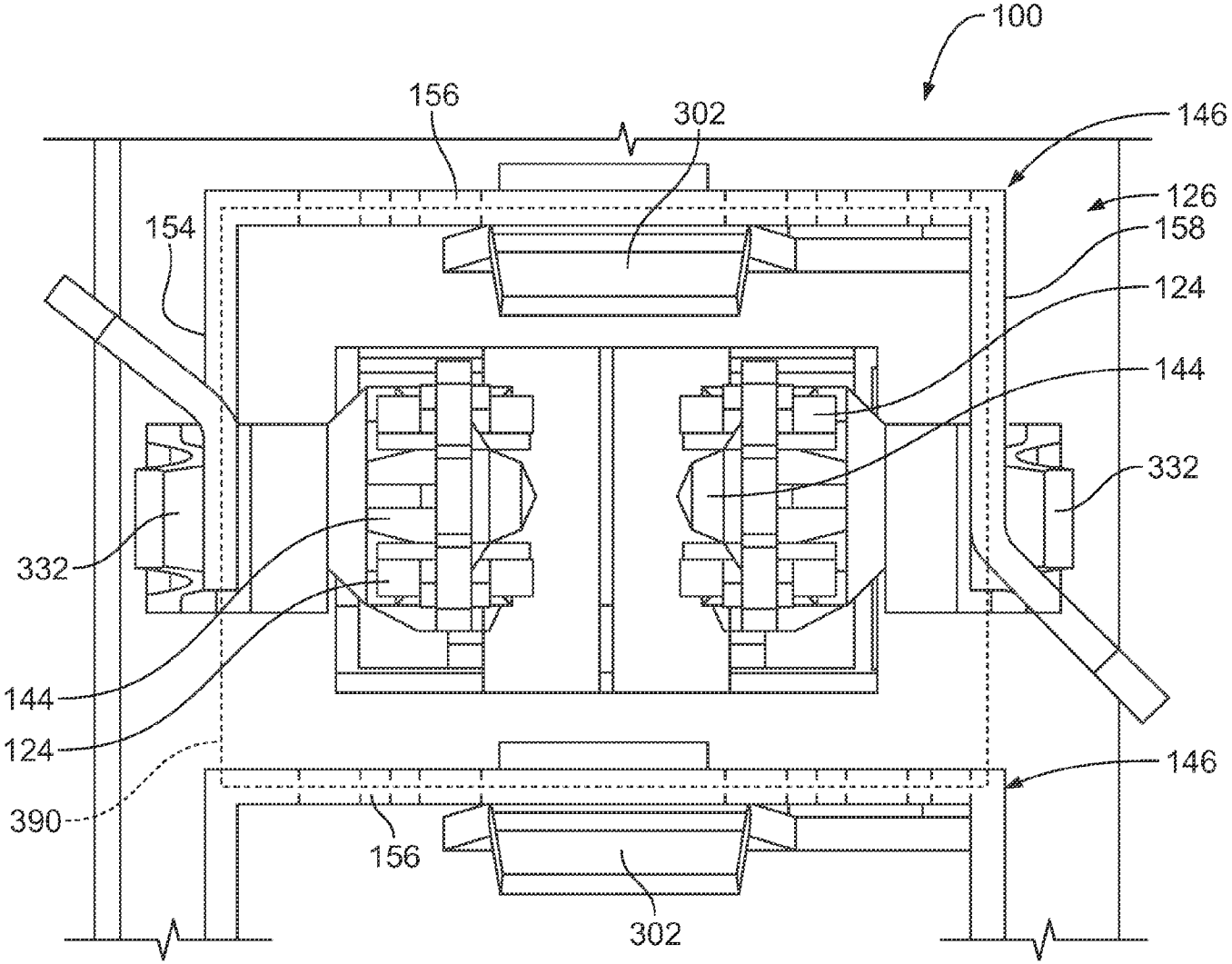
FIG. 6 is a front view of a portion of the electrical connector system shown in FIG. 1.

FIG. 6 is a front view of a portion of the electrical connector system 100, showing grounding beams 302 and grounding fingers 332 engaging the header shields 146. The front housing 120 (shown in FIG. 1) and the header housing 138 (shown in FIG. 1) are removed for clarity.

The header signal contacts 144 are mated to the receptacle signal contacts 124. The header shield 146 is C-shaped and surrounds the header signal contacts 144 and receptacle signal contacts 124 on the top and both sides. The header shield 146 below the header signal contacts 144 and receptacle signal contacts 124 extends across the bottom thereof to create a shielded mating zone 390. The shielded mating zone 390 is peripherally surrounded on all four sides thereof. In the illustrated embodiment, the grounding beam 302 engages an interior surface of the header shield 146 at the top wall 156, while the grounding fingers 332 engage exterior surfaces of the side walls 154, 158. In an exemplary embodiment, the grounding fingers 332 may engage other parts of the header shield 146, such as the interior surfaces of the walls 154, 158.

The shield structure 126 has multiple, redundant points of contact with the C-shaped header shield 146. For example, three points of contact are defined by the grounding fingers 332 and the grounding beam 302. The electrical performance of the electrical connector system 100 is enhanced with multiple ground contact points to the C-shaped header shield 146, as compared to systems that have a single ground contact point.

Figure 7:
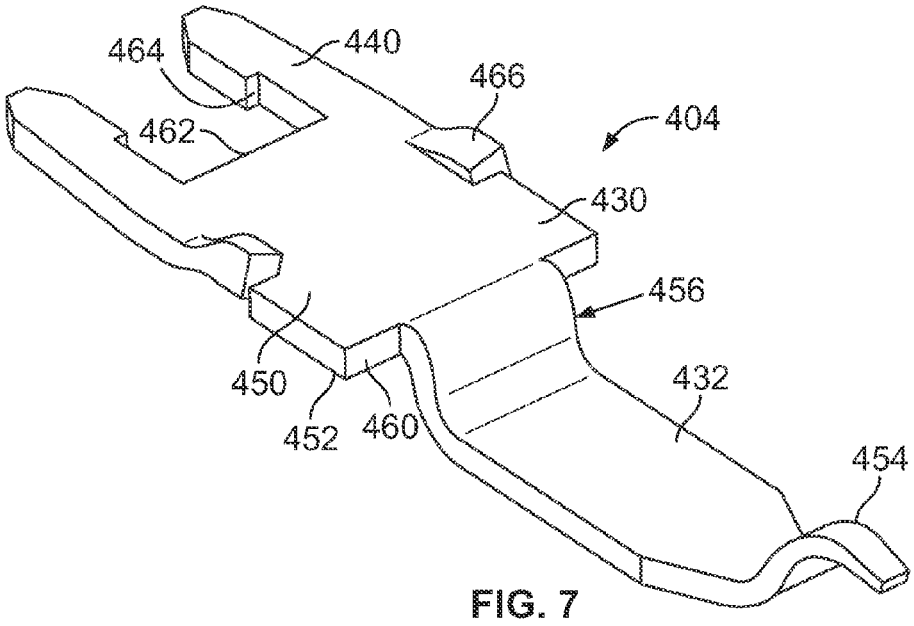
FIG. 7 is a perspective view of a ground clip formed in accordance with an exemplary embodiment.

FIG. 7 is a perspective view of a ground clip 404 formed in accordance with an exemplary embodiment. The ground clip 404 includes a base 430 and a grounding finger 432 extending from the base 430. The ground clip 404 includes mounting tabs 440 extending from the base 430. The mounting tabs 440 are used to secure the ground clip 404 to a conductive holder 402 (shown in FIG. 8). The mounting tabs 440 engage the conductive holder 402 to electrically and mechanically connect the ground clip 404 to the holder 402.

The ground clip 404 includes an inner surface 450 and an outer surface 452 opposite the inner surface 450. In an exemplary embodiment, the ground clip 404 is stamped and formed from a stock metal workpiece.

The grounding finger 432 is bent out of plane with respect to the base 430 and defines a deflectable spring finger that is configured to engage a corresponding header shield 146 (shown in FIG. 1). The grounding finger 432 includes a mating interface 454 proximate to a distal end thereof. The mating interface 454 is the portion of the grounding finger 432 that engages the header shield 146. The grounding finger 432 includes a transition section 456 proximate to the base 430. The transition section 456 transitions the grounding finger 432 out of the plane of the base 430.

The base 430 extends between a front 460 and a rear 462. The grounding finger 432 extends forward from the front 460. The mounting tabs 440 extend rearward from the rear 462. The mounting tabs 440 have latching surfaces 464 to secure the ground clip 404 in the conductive holder 402. The mounting tabs 440 may be deflectable to clip the mounting tabs 440 in position in the conductive holder 402. The ground clip 404 includes protrusions 466 extending from the base 430. The protrusions 466 are located at the top and bottom edges of the base 430 approximately centered between the front 460 and the rear 462. Other locations are possible in alternative embodiments. The protrusions 466 are configured to engage the conductive holder 402 to ensure electrical contact between the ground clip 404 and the conductive holder 402. Optionally, the protrusions 466 may be deflectable.

Figure 8:
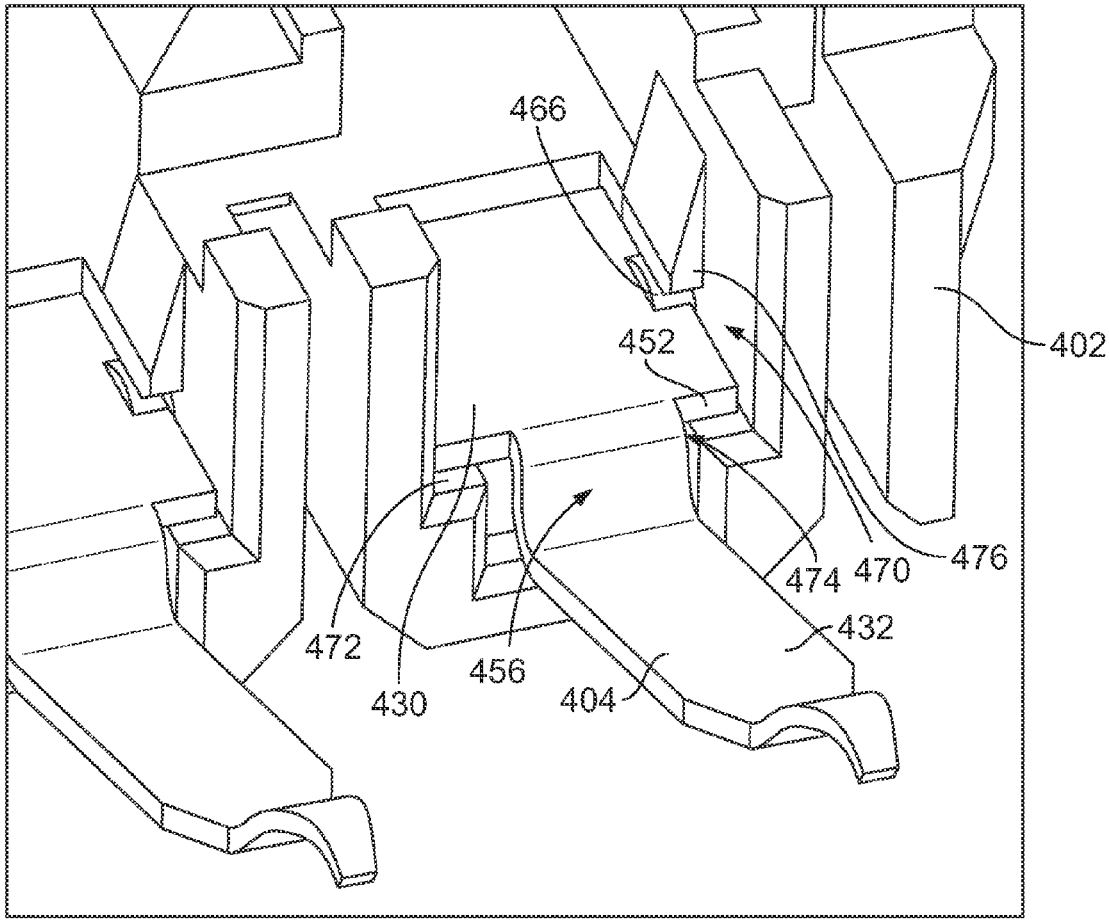
FIG. 8 is a front perspective view of a portion of a contact module holding the ground clips of FIG. 7.

FIG. 8 is a front perspective view of a portion of a conductive holder 402 for a contact module in accordance with an exemplary embodiment. Only one holder member of the conductive holder 402 is illustrated, and a corresponding mating half would be used to form the conductive holder 402 in a similar manner as with the conductive holder 202 (shown in FIG. 2). The ground clips 404 are coupled to the conductive holder 402 in corresponding channels 470 of the conductive holder 402. The channels 470 are configured to receive a frame assembly and corresponding receptacle signal contacts (not shown) in a similar manner as with the conductive holder 202.

Each channel 470 includes a wall defining an internal surface 472 along a side of the channel 470. The ground clip 404 is located on the side of the channel 470 in a pocket 474 formed in the internal surface 472. The ground clip 404 may be press fit in the pocket 474. The mounting tabs 440 (shown in FIG. 7) may be latched into the pocket 474 to secure the ground clip 404 therein. The protrusions 466 engage support walls 476 of the conductive holder 402 to ensure electrical connection between the ground clip 404 and the conductive holder 402. The protrusions 466 may bias the outer surface 452 of the base 430 against the internal surface 472 to ensure engagement between the outer surface 452 and the internal surface 472. The pocket 474 is shaped to accommodate the transition section 456 of the grounding fingers 432.

Figure 9:
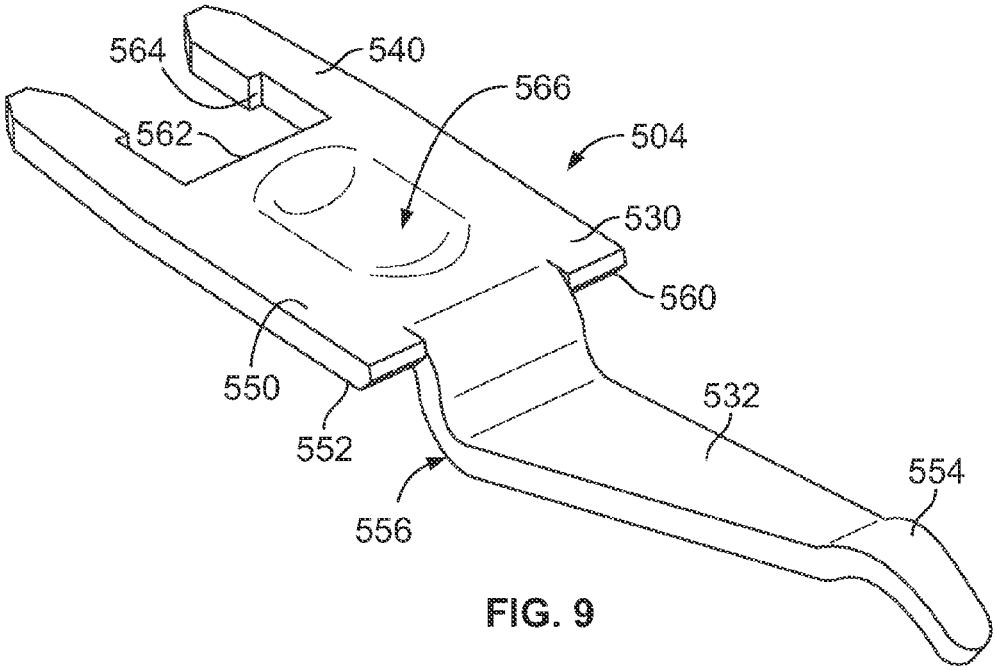
FIG. 9 is a perspective view of a ground clip formed in accordance with an exemplary embodiment.

FIG. 9 is a perspective view of a ground clip 504 formed in accordance with an exemplary embodiment. The ground clip 504 includes a base 530 and a grounding finger 532 extending from the base 530. The ground clip 504 includes mounting tabs 540 extending from the base 530. The mounting tabs 540 are used to secure the ground clip 504 to a conductive holder 502 (shown in FIG. 10). The mounting tabs 540 engage the conductive holder 502 to electrically and mechanically connect the ground clip 504 to the holder 502.

The ground clip 504 includes an inner surface 550 and an outer surface 552 opposite the inner surface 550. In an exemplary embodiment, the ground clip 504 is stamped and formed from a stock metal workpiece.

The grounding finger 532 is bent out of plane with respect to the base 530 and defines a deflectable spring finger that is configured to engage a corresponding header shield 146 (shown in FIG. 1). The grounding finger 532 includes a mating interface 554 proximate to a distal end thereof. The mating interface 554 is the portion of the grounding finger 532 that engages the header shield 146. The grounding finger 532 includes a transition section 556 proximate to the base 530. The transition section 556 transitions the grounding finger 532 out of the plane of the base 530.

The base 530 extends between a front 560 and a rear 562. The grounding finger 532 extends forward from the front 560. The mounting tabs 540 extend rearward from the rear 562. The mounting tabs 540 have latching surfaces 564 to secure the ground clip 504 in the conductive holder 502. The mounting tabs 540 may be deflectable to clip the mounting tabs 540 in position in the conductive holder 502. The ground clip 504 includes a protrusion 566 extending from the base 530. The protrusion 566 is centrally located on the base 530 between the front 560 and the rear 562. Other locations are possible in alternative embodiments. The protrusion 566 extends outwardly from the outer surface 552. The protrusion 566 is configured to engage the conductive holder 502 to ensure electrical contact between the ground clip 504 and the conductive holder 502.

Figure 10:
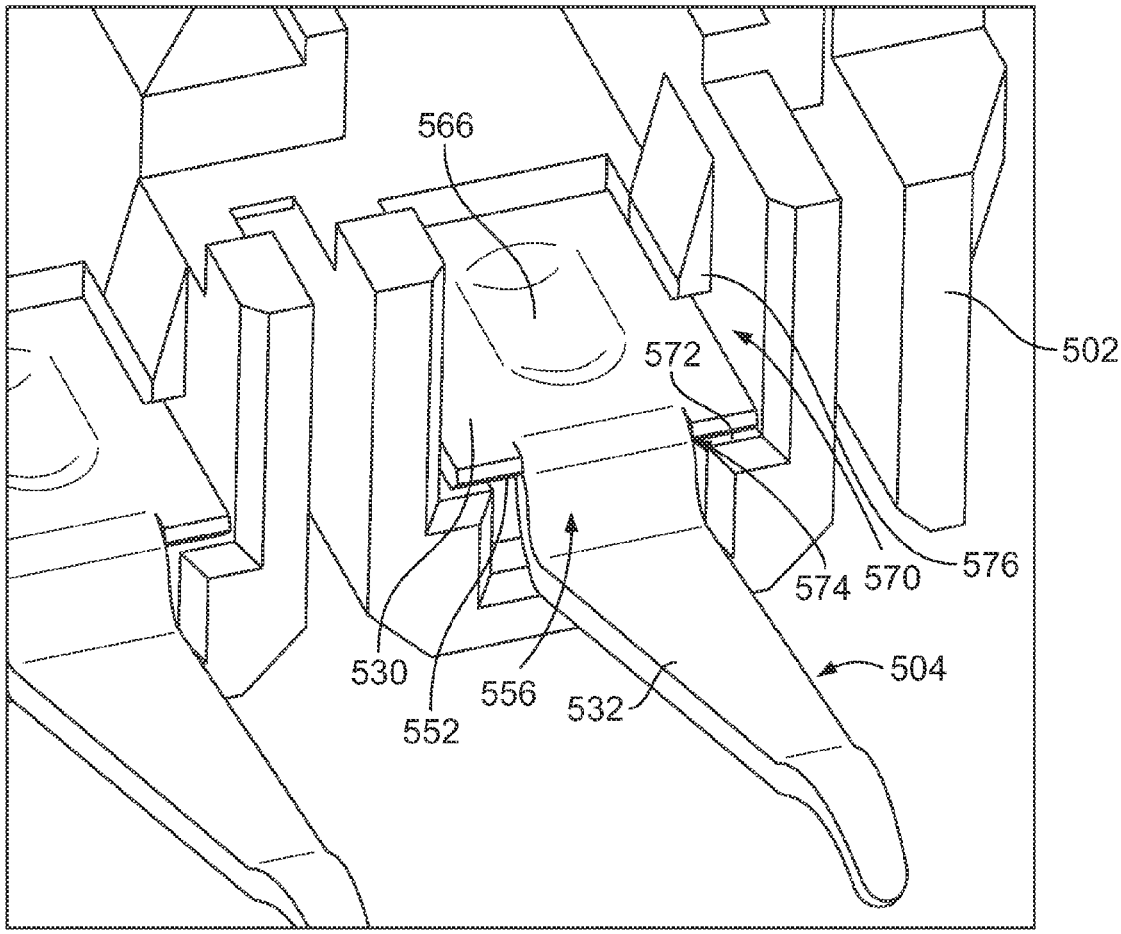
FIG. 10 is a front perspective view of a portion of a contact module holding the ground clips of FIG. 9.

FIG. 10 is a front perspective view of a portion of a conductive holder 502 for a contact module in accordance with an exemplary embodiment. Only one holder member of the conductive holder 502 is illustrated, and a corresponding mating half would be used to form the conductive holder 502 in a similar manner as with the conductive holder 202 (shown in FIG. 2). The ground clips 504 are coupled to the conductive holder 502 in corresponding channels 570 of the conductive holder 502. The channels 570 are configured to receive a frame assembly and corresponding receptacle signal contacts (not shown) in a similar manner as with the conductive holder 202.

Each channel 570 includes a wall defining an internal surface 572 along a side of the channel 570. The ground clip 504 is located on the side of the channel 570 in a pocket 574 formed in the internal surface 572. The ground clip 504 may be press fit in the pocket 574. The mounting tabs 540 (shown in FIG. 9) may be latched into the pocket 574 to secure the ground clip 504 therein. The protrusion 566 extends outward from the base 530 against the internal surface 572. The conductive holder 502 includes support walls 576 that hold the base 530 and/or the protrusion 566 against the internal surface 572 to ensure engagement between the outer surface 552 and the internal surface 572. The pocket 574 is shaped to accommodate the transition section 556 of the grounding fingers 532.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a contact module including a conductive holder having a first side wall and an opposite second side wall, the conductive holder having a chamber between the first and second side walls, the conductive holder having a front, the contact module including contacts arranged as differential pairs and held in the chamber, the contacts provided at the front of the conductive holder for electrical termination; and a plurality of ground clips received in the chamber and provided at the front of the conductive holder, the ground clips being mechanically and electrically connected to the conductive holder, the ground clips extending along corresponding contacts and providing electrical shielding for the contacts.

2. The receptacle assembly of claim 1, wherein the ground clips are provided on opposite sides of corresponding differential pairs of the contacts to provide shielding for the contacts.

3. The receptacle assembly of claim 1, wherein the ground clips have mating interfaces configured to be mated with corresponding header shields of the header assembly.

4. The receptacle assembly of claim 1, wherein each of the ground clips includes a base and a grounding finger extending from the base, the bases being mechanically and electrically connected to the conductive holder, the bases being positioned between a dielectric frame assembly holding the contacts and the conductive holder.

5. The receptacle assembly of claim 1, wherein each of the ground clips includes a base and a grounding finger extending from the base, the bases being staked into the conductive holder.

6. The receptacle assembly of claim 1, wherein the conductive holder has an internal surface defining the chamber, the internal surface having pockets formed therein, the ground clips being received in corresponding pockets.

7. The receptacle assembly of claim 1, wherein the chamber is divided into a plurality of channels, each channel receiving a corresponding differential pair of the contacts, each channel receiving at least two ground clips.

8. The receptacle assembly of claim 1, wherein the chamber is divided into a plurality of channels, the conductive holder providing peripheral shielding around each channel, the ground clips being arranged in pairs received in corresponding channels with one ground clip of the pair being arranged on one side of the contacts and the other ground clip of the pair being arranged on an opposite side of the corresponding contacts.

9. The receptacle assembly of claim 1, wherein the conductive holder includes support walls in the chamber that secure the ground clips in the chamber.

10. The receptacle assembly of claim 1, wherein the ground clips include protrusions engaging the conductive holder to electrically connect the ground clips to the conductive holder.

11. The receptacle assembly of claim 1, wherein the ground clips include mounting tabs extending therefrom engaging the conductive holder to secure the ground clips in the chamber.

12. A receptacle assembly comprising:

a contact module comprising a conductive holder having a first holder member and second holder member coupled to the first holder member, the conductive holder having a front, the conductive holder having a chamber between the first and second holder members, the chamber being divided into a plurality of channels;

a frame assembly received in the chamber, the frame assembly comprising a first dielectric frame received in the first holder member and a second dielectric frame received in the second holder member, each dielectric frame comprising a plurality of contacts and frame members supporting the contacts, the contacts being routed through corresponding channels, the contacts extending from the front for electrical termination; and ground clips received in corresponding channels of the chamber, the ground clips extending from the front of the conductive holder, the ground clips being mechanically and electrically connected to the conductive holder, the ground clips extending along corresponding contacts and providing electrical, shielding for the contacts.

13. The receptacle assembly of claim 12, wherein the ground clips are arranged in pairs with one ground clip of each pair positioned between the first holder member and the first dielectric frame and the other ground clip of each pair being positioned between the second holder member and the second dielectric frame.

14. The receptacle assembly of claim 12, wherein the contacts of the first dielectric frame are aligned with the contacts of the second dielectric frame to define differential pairs of contacts with one contact of each differential pair of contacts being supported by the first dielectric frame and the other contact of each differential pair of contacts being supported by the second dielectric frame, the contacts of each differential pair being flanked by corresponding ground clips.

15. The receptacle assembly of claim 12, wherein the channels are defined by tabs extending from the first and second holder members into the chamber, the channels being defined by internal surfaces of the holder members, the ground clips being coupled to the internal surfaces.

16. The receptacle assembly of claim 12, wherein the channels provide peripheral shielding around corresponding contacts, the ground clips being loaded into the channels such that the ground clips are positioned between the conductive holder and the corresponding contacts.

17. The receptacle assembly of claim 12, wherein the ground clips include bases and grounding fingers extending from the bases, the bases being mechanically and electrically connected to the conductive holder, the bases being positioned between the frame members and the conductive holder.

18. The receptacle assembly of claim 12, wherein the conductive holder has an internal surface defining the chamber, the internal surface having pockets formed therein, the ground clips being received in corresponding pockets.

19. An electrical connector assembly comprising:

a header assembly comprising a header housing, a plurality of header contacts held by the header housing, and a plurality of C-shaped header shields surrounding corresponding header contacts, the header shields having walls defining the C-shaped header shields; and a receptacle assembly matable to the header assembly, the receptacle assembly comprising:

a front housing matable to the header housing; and a contact module coupled to the front housing, the contact module comprising:

a conductive holder having a first holder member and second holder member coupled to the first holder member, the conductive holder having a front coupled to the front housing and a bottom configured to be mounted to a circuit board, the conductive holder having a chamber between the first and second holder members, the chamber including a plurality of channels extending between the front and the bottom;

a frame assembly received in the chamber, the frame assembly comprising a first dielectric frame received in the first holder member and a second dielectric frame received in the second holder member, each dielectric frame comprising a plurality of contacts and frame members supporting the contacts, the contacts being routed through corresponding channels, the contacts extending from the front of the conductive holder for electrical termination to corresponding header contacts; and ground clips received in corresponding channels of the chamber, the ground clips extending from the front of the conductive holder for electrical termination to corresponding header shields, the ground clips being mechanically and electrically connected to the conductive holder, the ground clips extending along corresponding contacts and providing electrical shielding for the contacts.

20. The electrical connector assembly of claim 19, wherein the ground clips include bases and grounding fingers extending from the bases, the bases being mechanically and electrically connected to the conductive holder, the bases being positioned between the frame members and the conductive holder.

* * * * *